United States Patent [19]

Chabert

[11] Patent Number: 5,052,383

[45] Date of Patent: Oct. 1, 1991

[54] DEVICE FOR SUPPLYING BREATHING GAS TO A DIVER

[75] Inventor: Jean-Marie Chabert, Valbonne, France

[73] Assignee: La Spirotechnique Industrielle et Commerciale, Carros, France

[21] Appl. No.: 496,344

[22] Filed: Mar. 20, 1990

[30] Foreign Application Priority Data

Mar. 21, 1989 [FR] France ..... 89 03696

[51] Int. Cl.[5] ..... A62B 7/04

[52] U.S. Cl. ..... 128/204.26; 128/205.24

[58] Field of Search ..... 128/204.25, 204.26, 128/204.29

[56] References Cited

U.S. PATENT DOCUMENTS

| | | | |
|---|---|---|---|
| 4,094,314 | 6/1978 | Le Cornec | 128/204.26 |
| 4,192,298 | 3/1980 | Ferraro et al. | 128/205.24 |
| 4,219,017 | 8/1980 | Shamlian | 128/204.26 |
| 4,337,766 | 7/1982 | Feathers | 128/204.26 |
| 4,572,175 | 2/1986 | Flynn | 128/205.24 |
| 4,572,176 | 2/1986 | Walther | 128/204.26 |
| 4,616,645 | 10/1986 | Pedersen et al. | 128/204.25 |
| 4,798,202 | 1/1989 | Chambonnet | 128/204.25 |

FOREIGN PATENT DOCUMENTS

| | | |
|---|---|---|
| 2421127 | 11/1975 | Fed. Rep. of Germany . |
| 2587437 | 3/1987 | France . |
| 925442 | 5/1963 | United Kingdom . |

*Primary Examiner*—Edgar S. Burr
*Assistant Examiner*—Stephen R. Funk
*Attorney, Agent, or Firm*—Curtis, Morris & Safford

[57] ABSTRACT

Apparatus to supply breathing gas to a diver. A pressure-reducing valve is opened and closed by a piston actuated by an extended rod whose end is coupled to an articulated control lever which is driven by a diaphragm. By increasing the distance from the articulated lever, through the rod to the pressure-reducing valve, the risk of icing caused by cooling energy generated at the pressure-reducing valve when the diver operates in very cold water is eliminated.

7 Claims, 1 Drawing Sheet

DEVICE FOR SUPPLYING BREATHING GAS TO A DIVER

BACKGROUND OF THE INVENTION

The present invention relates to a device for supplying breathing gas, particularly for divers, of the type which comprises, in a housing, a means for feeding a breathing gas which includes a pressure-reducing valve for the incoming gas, attached to a piston sliding in the bore of a cylinder and actuated by a longitudinally moving piston rod, which in turn is controlled by a lever whose one free end makes contact with a soft diaphragm, and with said housing having an opening to an inhaling-exhaling conduit ending in a mouthpiece.

This type of device makes it possible to supply to the user quantities of breathing gas which are just sufficient and which are at the pressure of the environment, thanks to the diaphragm which reacts to the varying ambient pressure, while the device for feeding breathing gas, which is similar to a pressure-reducing valve, ensures the final reduction of the pressure of the breathing gas whose pressure had been previously reduced to a moderate value in the first pressure-reducing stage which is mounted on the tank containing breathing gas for the user.

But, each time they occur, i.e. at the breathing rate, the drops in the gas pressure, which are necessary for the functioning of the gas-feeding device, cause a considerable amount of cooling. Problems caused by that cooling action at the first stage of pressure reduction can be handled easily, but the same is not true for the breathing device which comprises, as has been stated above, a complete set of moving parts. These various parts become cold and if, for example, a diver is moving in water whose temperature is close to 0° C., the temperature of some of the moving parts may drop below 0° C. Since the air exhaled by the diver is saturated with moisture, this moisture is converted to ice when it makes contact with the cold parts and as a result the parts "freeze" because of icing. Such frozen parts in the gas feeding device may cause the valve to stay open permanently and breathing gas is continually fed into the housing, which produces considerable breathing difficulties for the diver.

OBJECTS AND SUMMARY OF THE INVENTION

It is an object of the present invention to provide a breathing apparatus in which the aforenoted difficulty of "freezing" parts due to ice formation is eliminated.

In accordance with this invention, an extension to a piston rod is attached to a sliding support for the rod, the support being located opposite the gas inlet and pressure reducing valve, and an articulated control lever acts on the free end of the piston rod extension.

By maximizing the distance between the reducing valve, the piston rod and the articulation of the control lever, a sufficient distance is created between the area where the cold is generated and the articulated parts, thereby obviating the tendency of the parts to "freeze" in the open position of the valve, i.e. in a position where the gas supply and the production of cold are continual.

According to a feature of the invention, at least one of the parts which is included in the mechanical linkage between the piston and the diaphragm (whose movement controls the piston) is designed in such a manner that it substantially limits the flow of heat, thus limiting of thermal conductivity. Preferably, one or more of the piston rod, piston and piston rod extension is made of a material of low thermal conductivity. This further reduces heat transfer between the valve and the articulated parts (i.e. the piston rod and control lever).

BRIEF DESCRIPTION OF THE DRAWINGS

The characteristics and advantages of the invention are shown in the description below, referring to the attached drawings where.

DETAILED DESCRIPTION OF A PREFERRED EMBODIMENT

Figure 1:
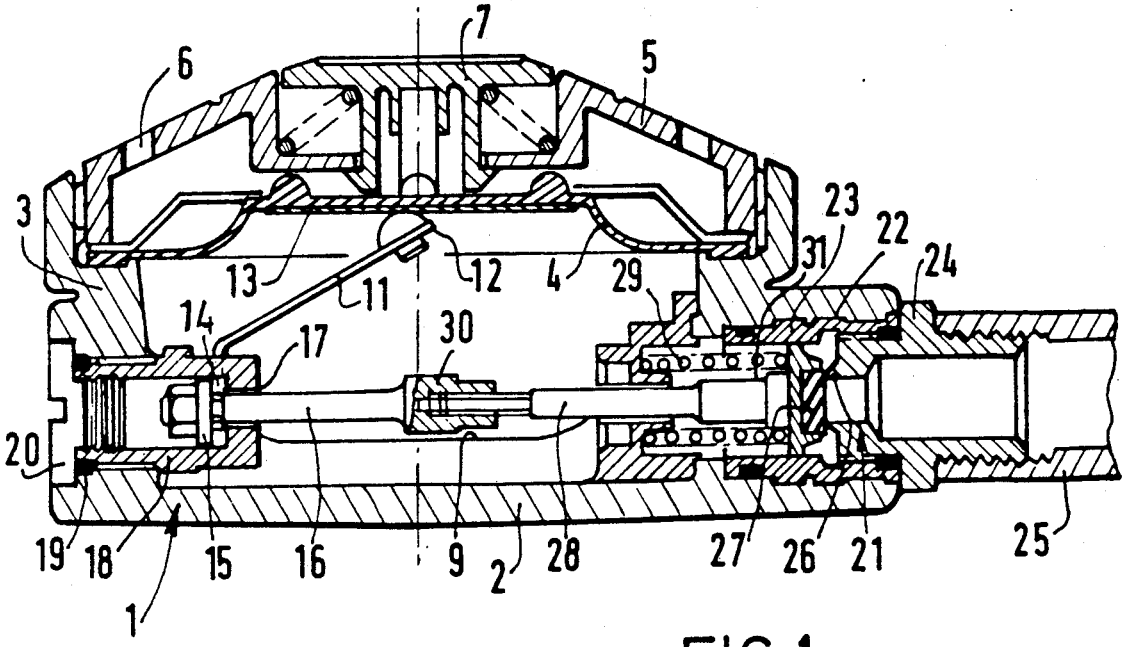
FIG. 1 is a sectional view of breathing apparatus for underwater divers.
Figure 2:
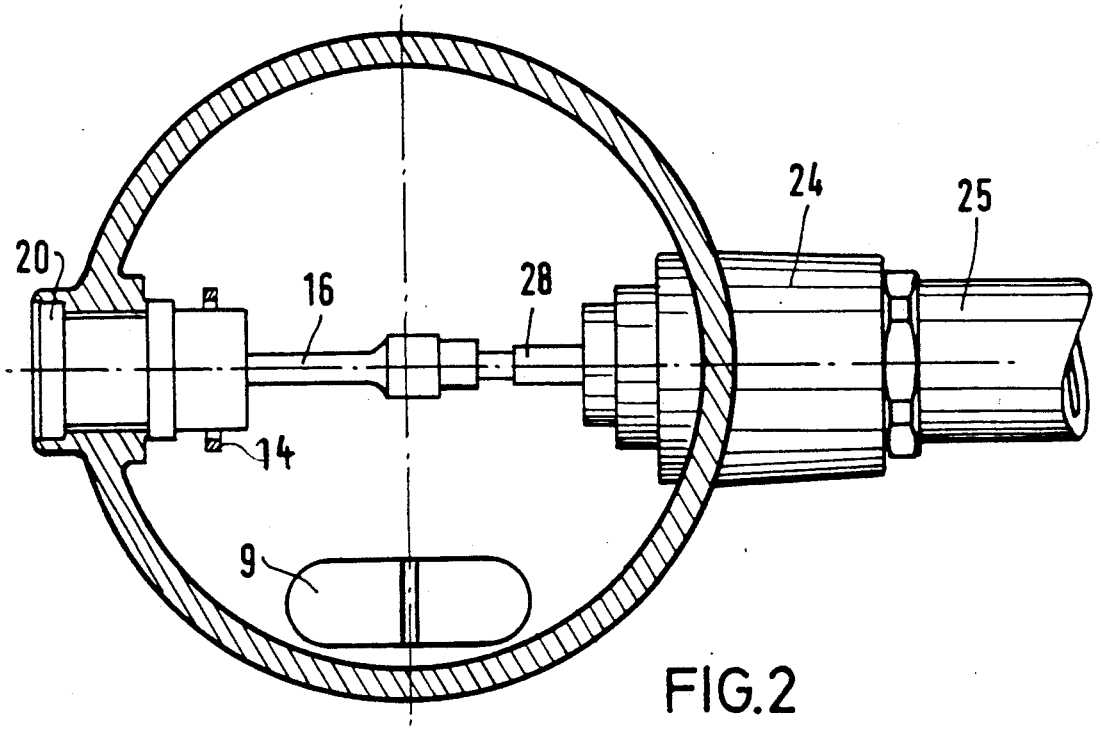
FIG. 2 is a top view of the same breathing apparatus.

In the attached drawings, the breathing apparatus comprises a housing 1 formed by a base 2 with a sidewall 3 and a soft diaphragm 4 clamped to the periphery of sidewall 3 by a cover 5, the latter having holes 6 and a forced supply reset button 7. The soft diaphragm 4 is exposed on one side (referred to as the outside) to the pressure of the surrounding water and on its other side (referred to as the inside) to the pressure of the breathing gas, which is drawn from the housing 1 during inhalation and expelled during exhalation through a conduit 9 with a buccal opening, the expelled gas being forced into the same housing 1 from which it escapes through an excess-pressure valve (not shown).

The pressure of the breathing gas is regulated as a function of the pressure of the ambient medium and of the breathing demands of the diver by means of an articulated lever 11, whose one end 12 contacts a central support plate 13 of diaphragm 4 and whose other end engages the free end of a rod 16 which slides in an opening 17 of a rod support 18 which, in turn, is attached to sidewall 3 of housing 1 by means of a seal 19 which is compressed by a threaded plug 20. This other end advantageously terminates in a fork 14 whose arms rest against a 18 flange of an adjusting screw 15 which is attached to the end of rod 16.

At an end of housing 1 opposite rod support 18 there is mounted a pressure-reducing device 21 for injecting breathing gas. Within a bore 22 in sidewall 3 is provided a cylindrical part 23 to which is attached a connector 24 coupled to a medium-pressure conduit 25, the connector forming a seat 26 for a valve 27 that is attached to a piston 31 at the end of a rod 28. The entire assembly is pushed by a compression spring 29 in a direction which tends to close the valve. Rod 28 is connected to rod 16 by means of a threaded length-adjusting fitting 30, which makes it possible to adjust the length of this assembly.

The apparatus operates in a conventional manner: As a result of the pressure drop caused by inhalation and transmitted through conduit 9, diaphragm 4 drops to adjust lever 11 in a clockwise direction and thus shift assembly 16, 30, 28 to the left, which lifts valve 27 from its seat 26, thus permitting breathing gas to enter the housing and flow through conduit 9 to the diver. When the diver exhales, the diaphragm is lifted and the movable parts are shifted in the opposite direction, the two rods 16 and 28 closing valve 27 by the action of return spring 29 and the exhaled air escapes through the exhaling valve (not shown).

Since lever 11 is located at a maximum distance from 18 reducing valve 27 and since the piston rod is comprised of extension 16, 28, lever 11 and its articulation to rod 16 are not exposed to the direct cooling action that occurs at the pressure-reducing valve 26–27. Hence, the danger of icing at the valve is practically eliminated. This danger of icing may be reduced further by making certain parts, such as rods 16 and 28 as well as piston 31, from materials that substantially do not conduct heat or by designing these parts in a suitable manner.

While the present invention has been described in connection with a preferred embodiment, it will be understood by those of ordinary skill in the art that many modifications and changes may be made therein without departing from the spirit and scope of the present invention, which is to be determined by reference to the appended claims.

What is claimed is:

1. An apparatus for supplying a breathing gas comprising: a housing defining an inner chamber and having a wall comprising a diaphragm exposed on one surface thereof to surrounding medium and on another surface thereof to the inner chamber, said housing additionally having first and second lateral walls; a pressure reducing valve in said inner chamber for injecting gas into the inner chamber, said pressure reducing valve comprising a valve body mounted on said first lateral wall of the housing; a slidable piston having a first rod extending outwardly of said valve body into said inner chamber, a valve member coupled and movable with said slidable piston, said valve member being enclosed by said valve body; a second rod threadably coupled to and longitudinally extending from said first rod and slidable therewith, said first and second rods remaining in fixed longitudinal alignment while sliding, said second rod having a distal end located closer to said second lateral wall than to said first lateral wall; and a lever connected between said distal end of said second rod and said diaphragm.

2. The apparatus of claim 1, wherein at least one of said first and second rods being made of material of relatively low thermal conductivity.

3. The apparatus of claim 2, further comprising length-adjusting connecting means for serially connecting said first and second rods.

4. The apparatus of claim 1, wherein said distal end is slidably received in an opening in a support mounted in the second lateral wall of the housing.

5. The apparatus of claim 4, comprising a fulcrum coupling for connecting said lever to said distal end.

6. The apparatus of claim 5, wherein said piston is spring loaded to maintain said valve member in a closed position.

7. The apparatus of claim 1, wherein said first rod extends substantially parallel to said diaphragm.

* * * * *